US006053101A

United States Patent [19]

Hix

[11] Patent Number: 6,053,101

[45] Date of Patent: Apr. 25, 2000

[54] TRANSFER PRINTING PRESS

[76] Inventor: Clifford A. Hix, 1008 Mill Rd., Pittsburg, Kans. 66762

[21] Appl. No.: 09/070,086

[22] Filed: Apr. 30, 1998

[51] Int. Cl.[7] ..... B05C 17/06

[52] U.S. Cl. ..... 101/126; 101/115

[58] Field of Search ..... 101/114, 115, 101/123, 124, 126, 129, 43, 44

[56] References Cited

U.S. PATENT DOCUMENTS

| | | | |
|---|---|---|---|
| 2,229,346 | 1/1941 | Shurley . | |
| 2,613,595 | 10/1952 | Weldon . | |
| 4,099,460 | 7/1978 | Bubley et al. . | |
| 4,606,268 | 8/1986 | Jaffa . | |
| 4,669,378 | 6/1987 | Lee . | |
| 4,750,419 | 6/1988 | Meredith . | |
| 4,798,135 | 1/1989 | Meredith . | |
| 4,879,948 | 11/1989 | Bubley . | |
| 4,909,142 | 3/1990 | Bubley . | |
| 4,981,074 | 1/1991 | Machita et al. . | |
| 5,020,430 | 6/1991 | Harpold et al. . | |
| 5,090,313 | 2/1992 | Chapman | 101/115 |
| 5,129,155 | 7/1992 | Hoffman et al. . | |
| 5,136,938 | 8/1992 | Pellegrina | 101/115 |
| 5,165,340 | 11/1992 | Karlyn et al. . | |
| 5,195,434 | 3/1993 | Hoffman . | |
| 5,226,362 | 7/1993 | Iaccino et al. . | |
| 5,309,831 | 5/1994 | Fuqua et al. . | |
| 5,313,882 | 5/1994 | Karlyn et al. . | |
| 5,335,594 | 8/1994 | Karlyn et al. . | |
| 5,375,516 | 12/1994 | Hasegawa | 101/115 |
| 5,553,536 | 9/1996 | Van Os | 101/115 |

FOREIGN PATENT DOCUMENTS

| | | | |
|---|---|---|---|
| 130751 | 1/1985 | European Pat. Off. | 101/115 |

*Primary Examiner*—Ren Yan

*Attorney, Agent, or Firm*—Hovey, Williams, Timmons & Collins

[57] ABSTRACT

A preferred screen printing press (10) includes a plurality of print stations each having a print head (64) in registration with a platen (26) with the print head and platen being shiftable between a spaced position and a print position, and further includes a substrate handling assembly (20) for shifting a substrate from one printing station to another. The preferred press (10) also includes a plurality of curing stations each including a curing platen (28) and a heater for heating the platen to a selected ink curing temperature. The preferred print head (64) includes a lifting mechanism in the nature of air cylinders (96, 98) for applying a constant lifting force to the rearward edge of a print screen (94) in order to lift the screen (94) under this constant force and as the squeegee (104) moves therealong.

23 Claims, 8 Drawing Sheets

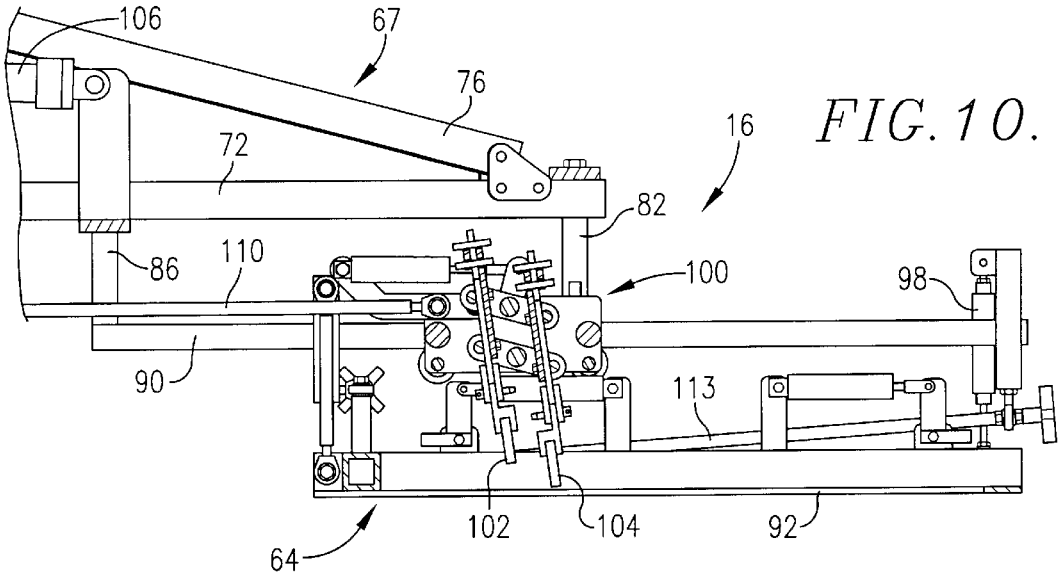
FIG. 10.
FIG. 11.
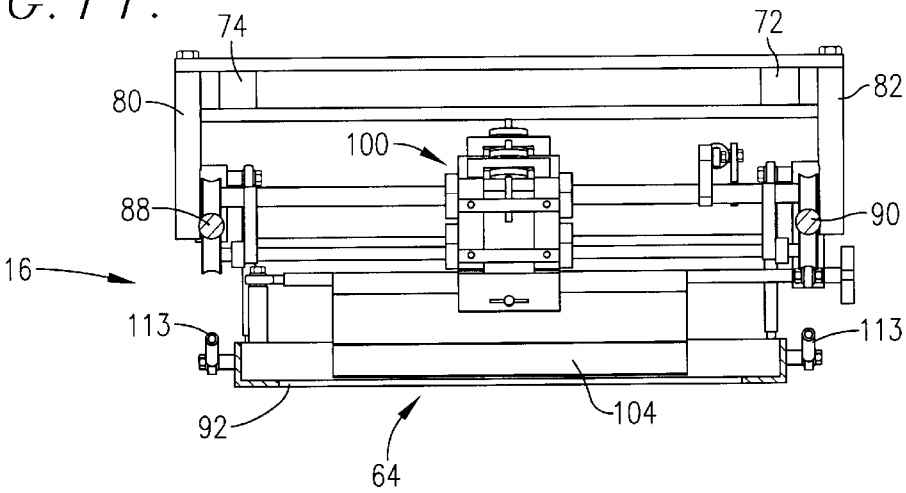
FIG. 12.
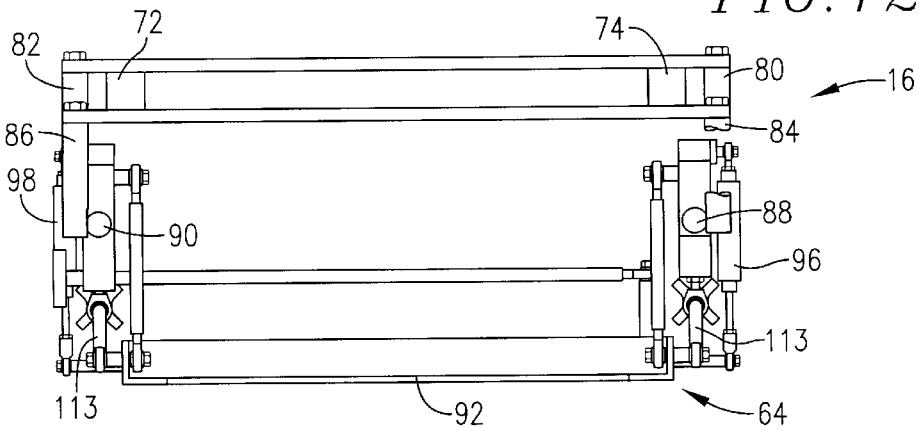

TRANSFER PRINTING PRESS

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of screen printing presses and, in particular, to a press for printing heat transfers on a substrate.

2. Discussion of the Prior Art

Heat transfers are preprinted artwork or the like that are printed in a mirror image or facedown orientation on a specialized substrate. The ink used in the printing of heat transfers must be semi-cured or gelled after each color is printed and must be printed with a heavy deposit to ensure the proper transfer from the substrate to the garment and to ensure a durable, finished product. To apply a transfer to an article of clothing or the like, the transfer is placed against the article and a heated iron or press is used to heat the transfer while pressing it against the article until the ink of the artwork releases from the substrate and melts into the article. When the substrate is removed, the artwork remains on the article.

It is conventional to employ a multi-station, turntable-type printing press for printing transfers. Such a conventional press includes an upstanding frame including a center post about which a loading and unloading station, a plurality of printing stations, and a plurality of drying stations are disposed. Silk screen printing assemblies are supported on the frame at each printing station, and a conventional drying means is disposed at each drying station. A turntable is supported on the frame for rotation about the center post, and includes a plurality of vacuum beds that rotate with the turntable and on which the transfers are supported.

Each unprinted substrate is placed on the bed positioned at the loading/unloading station and is held in place on the bed by negative pressure drawn through orifices in the bed so that the substrate is rotated with the turntable as a different color of the transfer is printed on the substrate at each printing station and cured at each curing station. Once printing of the transfer is complete, the bed carrying the substrate is rotated to the loading/unloading station and the negative pressure is relieved so that the substrate carrying the completed transfer may be removed from the bed.

Heat is commonly used to dry or cure the ink of the transfers subsequent to each printing operation. The temperature of the substrate must be kept within a narrow range suitable for curing. If the temperature of the substrate gets too hot, the substrate may scorch or the ink may over-gel, ruining the transfer. If the temperature is too cool, the ink will not cure and may stick to subsequent printing assemblies. Further, within this range of temperatures at which the transfers must be cured, different temperatures work better for different colors and types of inks, and it is essential that the curing operation be tailored to the particular color or type of ink applied in order to obtain proper curing of each color on the transfers.

Because in conventional printing presses, the vacuum beds are rotated with the substrates through the sequential printing and curing operations, heat builds up in the beds and substrates as the beds rotate through each curing operation. If the heat build-up is severe, the ink will continue to be heated after the drying operations, causing the ink to over-gel and ruining the transfer or remain semi-molten, causing it to stick to subsequent screens. Thus, it is necessary to slow or stop the printing process in order to permit the beds to cool after each curing operation and prior to subsequent printing operations. Alternately, other means are known for insulating the substrates from the vacuum beds so that heat carried by the beds is not conducted to the inks of the transfer.

In addition to the heat transfer problems presented by the use of vacuum beds on a rotatable turntable, the use of such a construction also requires that rotation of the turntable be repeatedly started and stopped as the beds are rotated from one station to the next. However, the weight of the beds on the turntable impedes the ability of a conventional indexing mechanisms from quickly and accurately rotating the turntable to each desired position relative to the printing assemblies.

Also, prior art presses use infrared for ink curing. The infrared heat cannot be controlled with the desired level of precision. As a result, the ink can be overheated.

The high viscosity of transfer printing inks requires the screen to be lifted progressively during the print stroke thereby effecting a gradual separation or peel between the screen and the substrate behind the squeegee. Screens gradually lose tension because of the constant flexing during printing operations. A low tension screen must be lifted higher and more quickly than one with greater tension if proper peeling action is to occur. In prior art printing heads, the screen is linked with the squeegee mechanism for lifting the screen as the squeegee travels through the print stroke. If the operator does not properly adjust the lifting mechanism, the print quality can be adversely affected.

Finally, turntable-type transfer printing presses include structural members for holding the print heads. These structural members are positioned over the screen and inhibit operator access for adjustments and ink addition.

SUMMARY OF THE INVENTION

The present invention solves the prior problems discussed above and presents a distinct advance in the state of the art. In particular, the screen printing press hereof provides for precise control of the ink curing process, lifts the print screen at the proper angle regardless of the screen tension and enables ready operator access for adjustments and ink addition.

The preferred screen printing press includes a plurality of print stations each having a print head in registration with a platen wherein the print head and platen are shiftable between a spaced position and a print position, and further includes a substrate handling assembly for shifting a substrate from one printing station to another. The preferred press also includes a plurality of curing stations each including a platen and a heater for heating the platen to a selected ink curing temperature. The preferred print head includes a lifting mechanism for applying a constant lifting force to the rearward edge of a print screen in order to lift the screen under this constant force as the squeegee moves therealong. Other preferred aspects of the present invention are disclosed herein.

BRIEF DESCRIPTION OF THE DRAWING FIGURES

FIG. 10 is a view similar to FIG. 9 but showing the squeegee in the retracted position;

FIG. 11 is an inboard elevational view of the print head of FIG. 8;

FIG. 12 is an outboard elevational view of the print head of FIG. 8;

DESCRIPTION OF THE PREFERRED EMBODIMENTS

Figure 1:
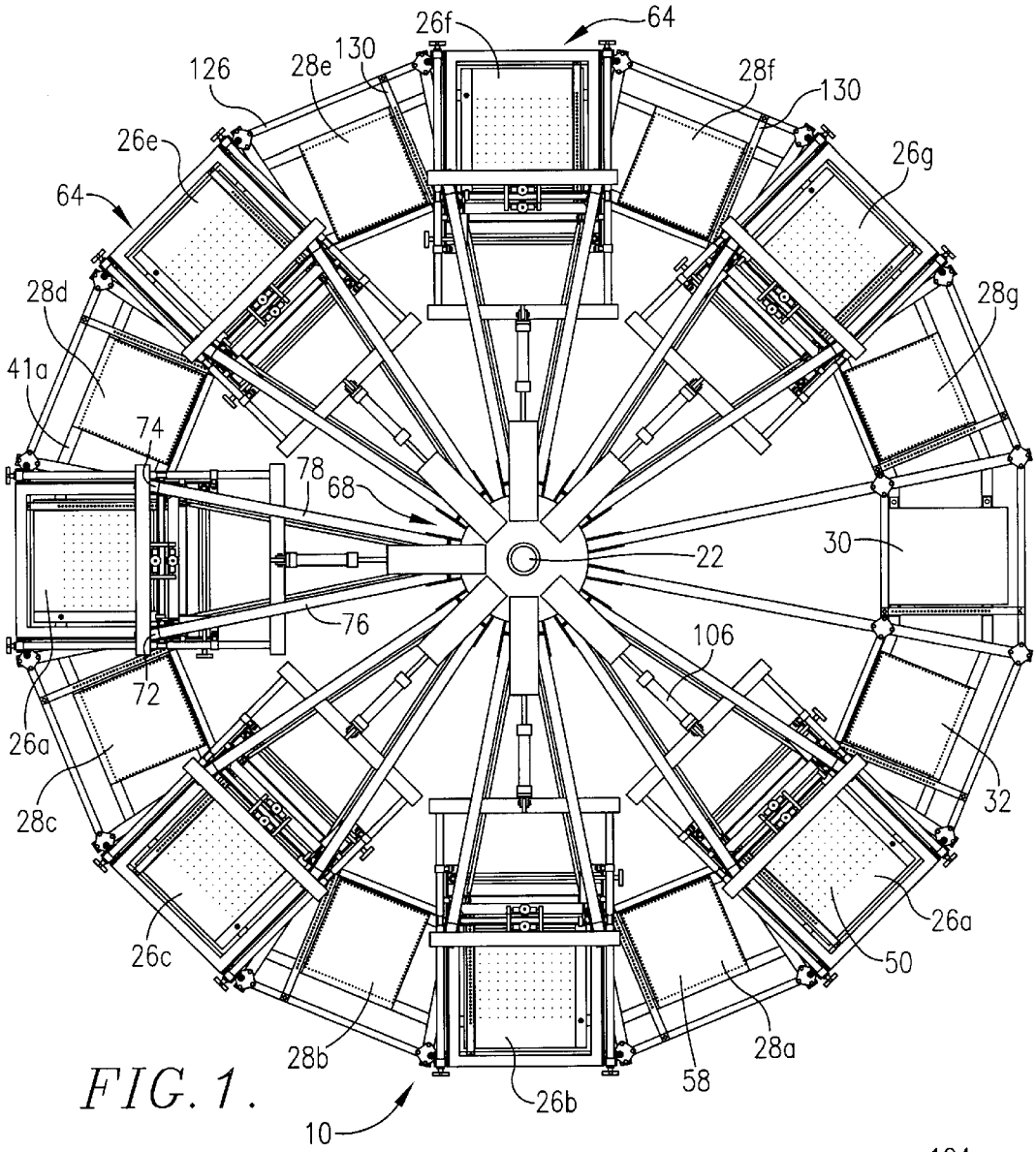
FIG. 1 is a top plan view of the preferred screen printing press in accordance with the present invention.

The drawing figures illustrate preferred screen print press 10 in accordance with the present invention. Press 10 broadly includes support base 12, platen assembly 14, print head assembly 16, and substrate handling assembly 20.

Support base 12 includes center post 22 and four, evenly spaced, support legs 24 composed of square steel tubing coupled with and extending outwardly from post 22 configured for providing a stable support for press 10.

Platen assembly 14 includes seven print platens 26 (individually designated 26*a*, 26*b*, 26*c*, 26*d*, 26*e*, 26*f*, 26*g*) and seven curing platens 28 (individually designated 28*a*, 28*b*, 28*c*, 28*d*, 28*e*, 28*f*, 28*g*). Assembly 14 also includes loading and unloading platen 30, and preheat platen 32. Platens 26–32 are evenly spaced about the periphery of press 10 as illustrated in FIG. 1.

Print platens 26 are spaced about the periphery of printing press 10 with a curing platen 28 adjacent each print platen 26. Loading and unloading platen 30 is positioned next to curing platen 28*g* and preheat platen 32 is positioned between platen 30 and print platen 26*a*.

Platen assembly 14 further includes tubular member 34 received about center post 22 and shiftable up and down relative to post 22. Upper hub 36, made up of two, circular spaced plates, is attached to member 34 adjacent to the upper end thereof and lower hub 38, also made of two, circular spaced plates, is attached to member 34 adjacent the lower end thereof.

Figures 2, 3, 7:
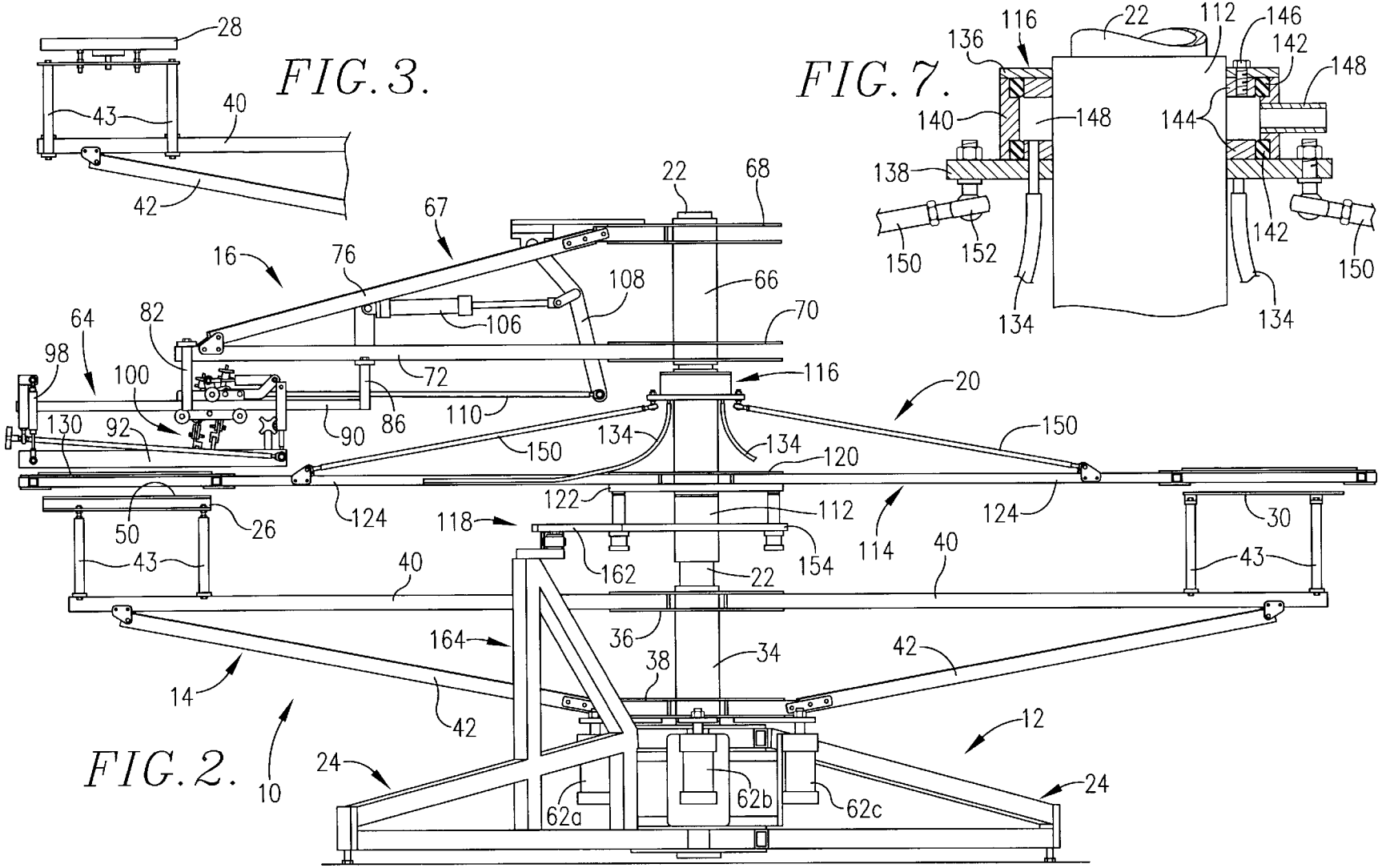
FIG. 2 is a partial side elevational view of the press of FIG. 1.
FIG. 3 is a partial side elevational view of a heating station of the press of FIG. 1.
FIG. 7 is a partial sectional view of the vacuum hub of the press of FIG. 1.
Figure 4:
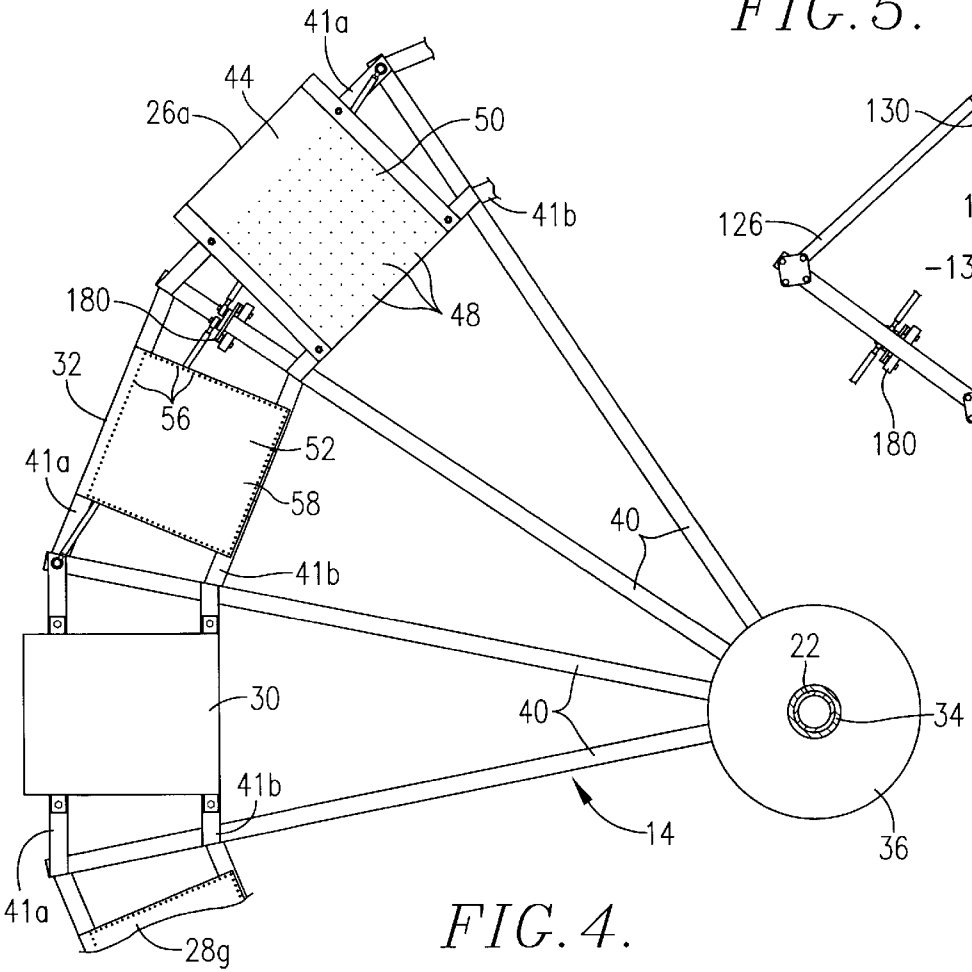
FIG. 4 is a partial top plan view of the platen assembly of FIG. 1.

Sixteen, evenly spaced, support arms 40 composed of square steel tubing are coupled between the plates of upper hub 36 and extend radially therefrom. Similarly, sixteen, evenly spaced, brace arms 42, also composed of square steel tubing, are coupled between the plates of lower hub 34 and extend outwardly therefrom. The distal ends of brace arms 42 are connected to respective support arms 40 near the outboard ends thereof in order to form a conventional triangular brace structure as shown in FIG. 2. Cross beams 41*a* interconnect adjacent support arms 40 at the ends thereof with cross beams 41*b* also interconnecting adjacent arms 40 but inboard of beams 41*a*. Four platen support posts 43 extend upwardly from each pair of cross beams 41*a,b* and support a respective platen 26–32 thereon as illustrated in FIGS. 2–4.

Each print platen 26 includes spaced, upper 44 and lower not shown plates welded with spacers at the edges thereof to form an internal vacuum chamber coupled with a conventional vacuum source. A plurality of evenly distributed, vacuum holes 48 are defined through upper plate 44 for vacuum holding of a substrate on upper platen face 50.

Similarly, each curing platen 28 includes spaced, upper 52 and lower not shown plates welded with spacers at the edges thereof to form an internal vacuum chamber also coupled with a conventional vacuum source. Vacuum holes 56 are defined through upper plate 52 for vacuum holding of a substrate on upper substantially stationary curing face 58. Holes 56 are configured in a rectangular arrangement adjacent the edges of face 58.

Each curing platen 28 also includes a conventional, electric-resistance heater coupled for heating upper plate 52 and connected to a thermostat and temperature control dial. This allows each curing platen to be set and controlled to a selected curing temperature according to the curing needs of the ink applied by the adjacent print station. For example, curing station 28*a* would be set for curing temperature according to the ink applied by the print station associated with print platen 26*a*.

Platen assembly 14 further includes shifting mechanism 60 having four actuators preferably conventional air cylinders 62*a*, 62*b*, 62*c* and 62*d* evenly spaced about center post 22 and coupled with the framework of support base 12 immediately below lower hub 38. The shaft of each cylinder 62*a–d* is connected to lower hub 38. Cylinders 62*a–d* are sized and positioned to lift platen assembly 14 along center post 22 upon the application of sufficient air pressure from a conventional source of compressed air.

More particularly, two of the cylinders positioned on opposed sides of center post 22 such as cylinders 62*a* and 62*c* are coupled with a conventional air regulator (not shown). This air regulator is adjusted to maintain enough air pressure on cylinders 62*a,c* so that they balance the weight of platen assembly 14.

Figure 13:
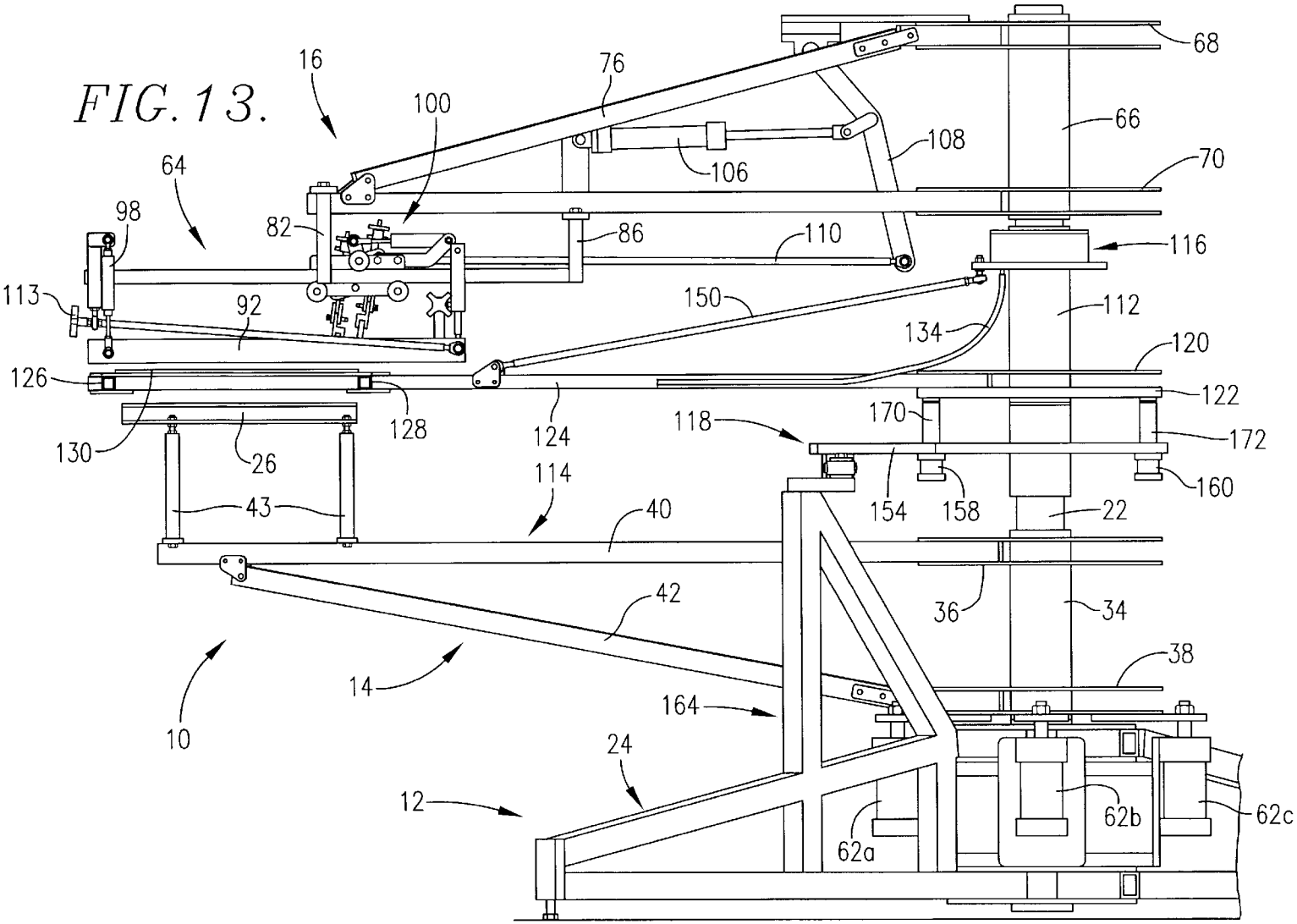
FIG. 13 is a partial side elevational view of a printing station of FIG. 1 showing the print head and platen in the spaced position.
Figure 14:
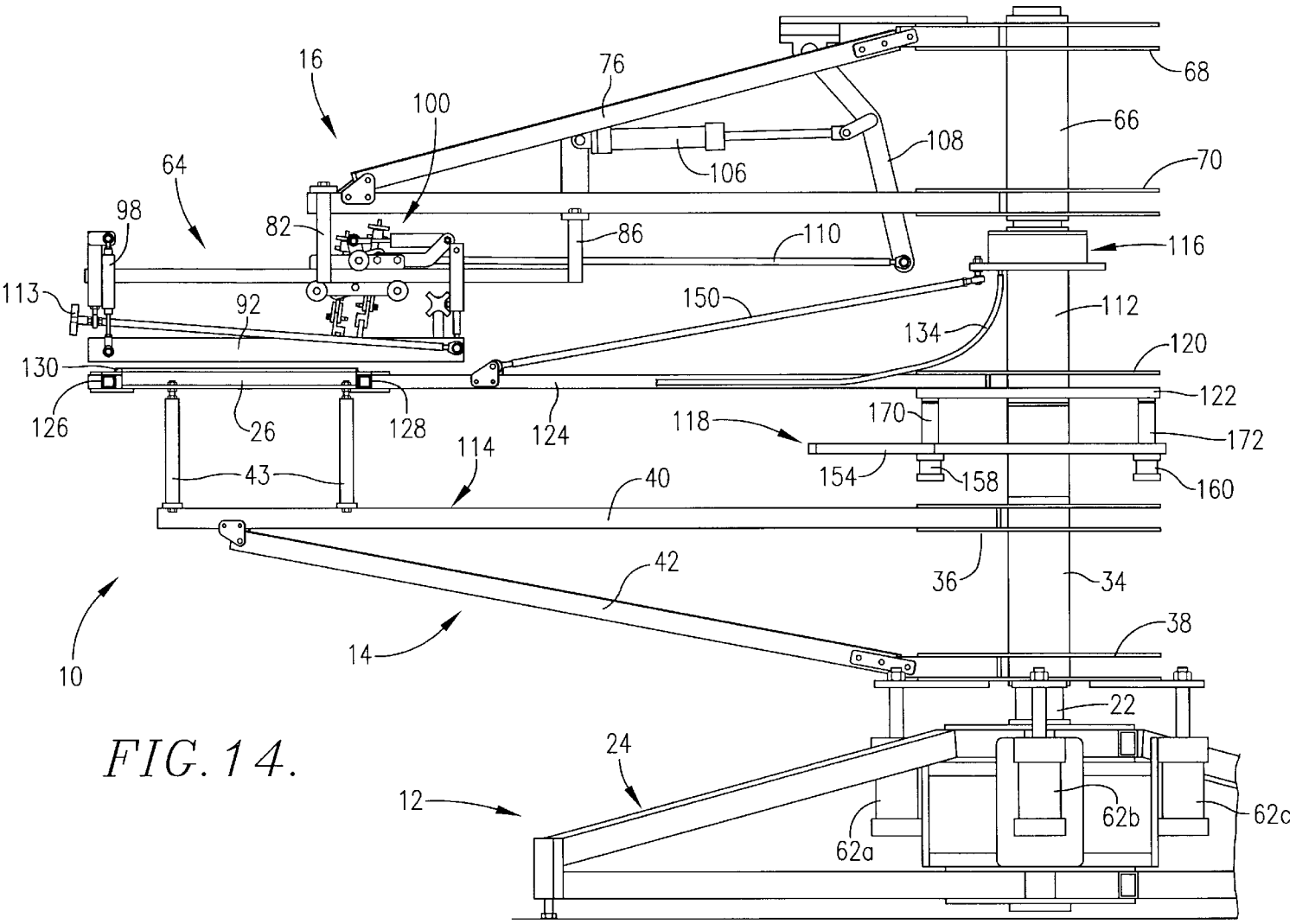
FIG. 14 is a view similar to FIG. 13 but showing the print head and platen in the intermediate position.
Figure 15:
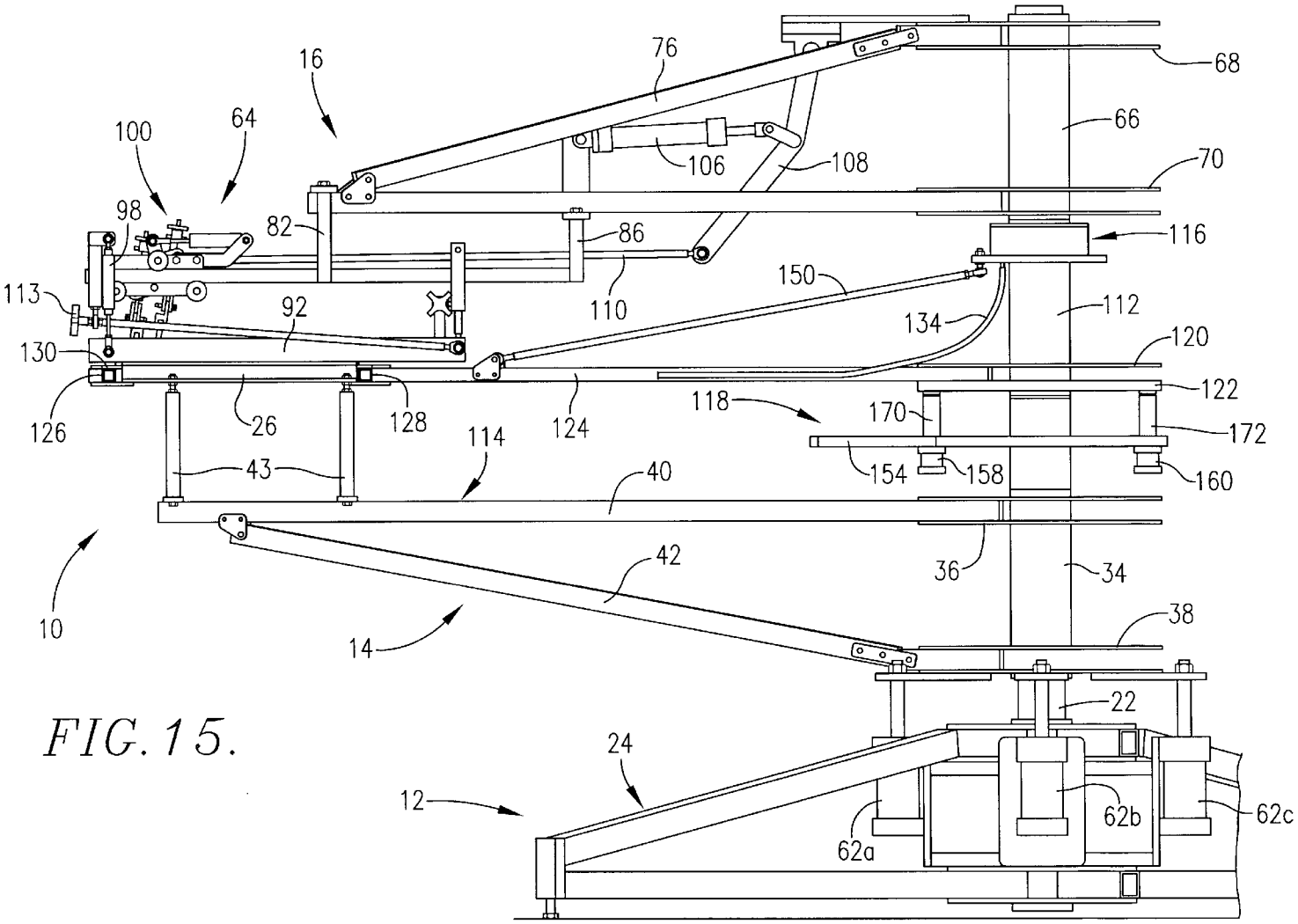
FIG. 15 is a view similar to FIG. 13 but showing the print head and platen in the print positions.

The other two cylinders, 62*b* and 62*d* (not shown), are used to shift platen assembly 14 from the lowered, spaced position as shown in FIG. 13, through the intermediate position of FIG. 14, to the raised, print position of FIG. 15. A faster shifting response is achieved because cylinders 62*b,d* do not need to overcome the weight of platen assembly 14 before the assembly can be pushed up along center post 22. Moreover, the air exhausted by cylinders 62*b,d* when assembly 14 is shifted downwardly is half the amount of air that would otherwise be used if all four cylinders were used for the shifting motion. That is, cylinders 62*a,c* are maintained with the static air pressure and do not exhaust air with each shift of platen assembly 14. Thus, compressed air is saved to reduce the operating cost of press 10.

Print head assembly 16 includes seven print heads 64 (individually designated as 64*a*, 64*b*, 64*c*, 64*d*, 64*e*, 64*f*, 64*g*) positioned above and in registration with print platens 26*a–g* respectively. A print head and corresponding print platen make up a respective printing station.

Print head mounting assembly 67 couples print heads 64 with center post 22. Mounting assembly 67 includes tubular body 66 positioned around and fixed center post 22 adjacent the upper end thereof. Top hub 68, made up of two, circular spaced plates, is attached to body 66 adjacent the upper end thereof. Bottom hub 70, also made of two, circular spaced plates, is attached to body 66 adjacent the lower end thereof.

For each print head, a pair of horizontal mounting arms 72 and 74 extend radially from between the plates of bottom hub 70. Similarly for each print head, a pair of brace arms 76 and 78 extend from top hub 68 with the distal ends thereof coupled with respective mounting arms 72, 74 to form a triangular support structure shown in FIG. 2, for example. Mounting rods 80, 82, 84 and 86 suspend each print head 64 from a respective pair of mounting arms 72, 74. As best viewed in FIG. 8, mounting rods 80–86 couple with the framework of a print head on opposed sides thereof. This leaves the screen, squeegees and other components of the print head unobstructed and thereby accessible for operator adjustment and ink addition.

Referring to FIGS. 8–15, each print head 64 includes spaced frame members 88 and 90 coupled with the lower ends of mounting rods 80–86, and screen frame 92 supporting screen 94 and screen lift air cylinders 96 and 98. Each print head 64 further includes squeegee assembly 100 supporting flood bar 102 and squeegee 104, squeegee drive cylinder 106 interconnected with squeegee assembly 100 by pivot arm 108, tie rod 110, and screen adjuster 113.

Figure 8:
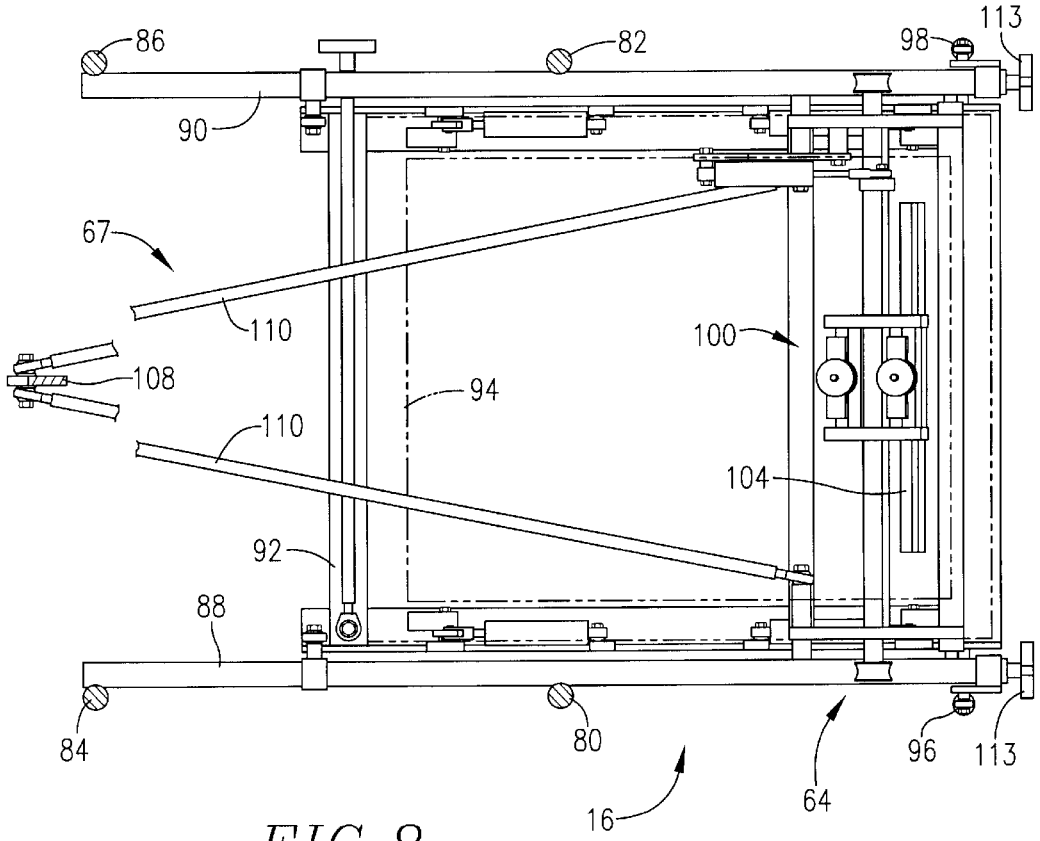
FIG. 8 is a partial top plan view of a print head of the press of FIG. 1.
Figure 9:
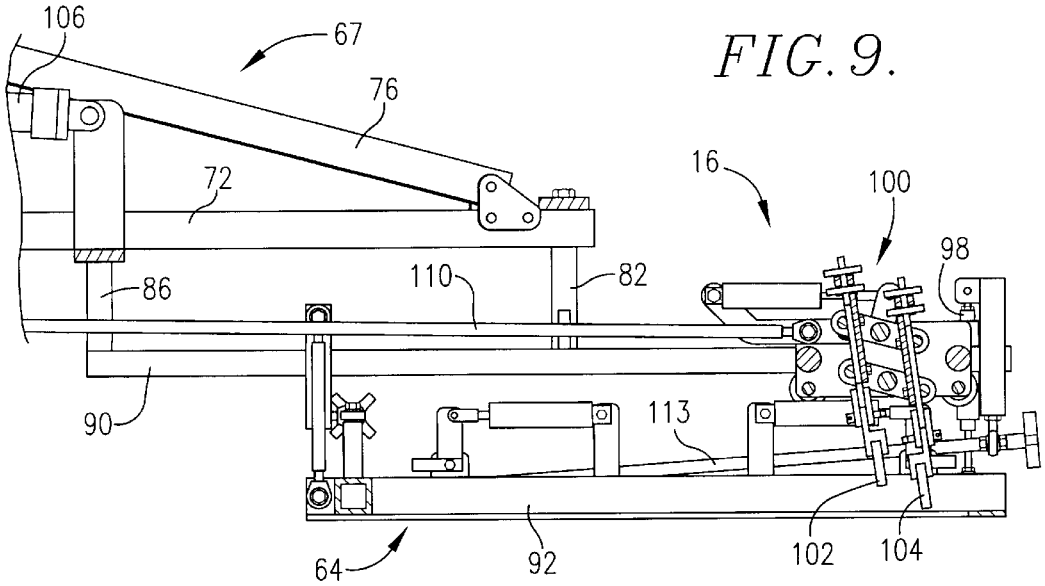
FIG. 9 is a partial side elevational view in partial section of the print head of FIG. 8 showing the squeegee in the extended position.

FIGS. 8 and 9 show squeegee assembly 100 in the forward position adjacent the rearward (outboard) edge of screen 94. In this position, squeegee drive cylinder 106 is retracted. During a print operation, cylinder 106 extends and shifts pivot arm 108 in order to pull tie rod 110 thereby pulling squeegee 104 along screen 94 to the forward position illustrated in FIG. 10, for example.

Screen lift cylinders 96, 98 are used in place of the prior art linkage mechanism that lifts the rearward (outboard) edge of the screen as the squeegees move therealong. A conventional air regulator (not shown) applies a constant air pressure (e.g., 30 psig) to cylinders 96, 98 during the print stroke. As a result, a constant lift force is applied to the rearward edge of the screen. This has the effect of compensating for variations in screen tension. That is, despite variations in screen tension, the screen is lifted with a constant force resulting in a proper rate and lift angle regardless of screen tension thereby aiding consistent print quality.

Figure 5:
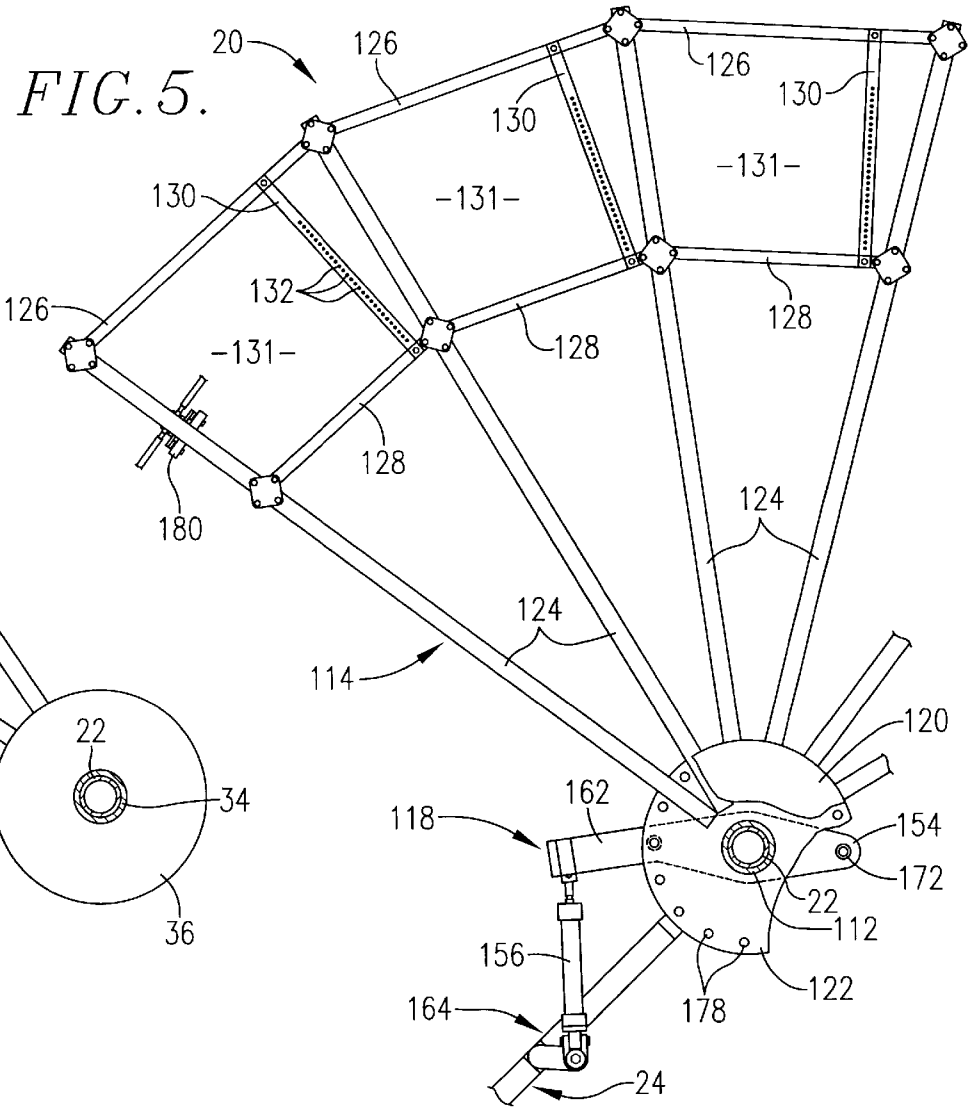
FIG. 5 is a partial plan view of the substrate shifting mechanism of the press of FIG. 1.

Referring to FIGS. 2 and 5, for example, substrate handling assembly 20 includes tubular portion 12, vacuum bar assembly 114, vacuum hub 116 and indexing mechanism 118. Tubular portion 112 is received about center post 22 between platen assembly 14 and print head assembly 16 and is slidable up and down and rotatable about center post 22.

Vacuum bar assembly 114 includes spaced, circular, top and bottom plates 120 and 122 coupled midway about tubular portion 112; sixteen, spaced support members 124 extending radially from between plates 120, 122; outboard cross arms 126 interconnecting the respective distal ends of adjacent support members 124; inboard cross arms 128 also interconnecting adjacent support members 124 inboard and spaced from respective cross arms 126; and sixteen vacuum bars 130 interconnecting each pair of cross arms 126, 128. Assembly 114 is configured so that support members 124 are in registration with support arms 40. Moreover, vacuum bars 130 and cross arms 126, 128 are positioned relative to support members 124 to define respective platen openings 131 for receiving a corresponding platen 26–28 therethrough during operation, as discussed further herein.

Each vacuum bar 130 is tubular in configuration and includes a plurality of vacuum holes 132 along the length of the upper surface thereof and positioned in a substantially straight line. Also, vacuum lines 134 interconnect vacuum bars respectively with vacuum hub 116.

FIG. 7 best illustrates vacuum hub 116 coupled with tubular portion 112 adjacent the upper end thereof. As illustrated, hub 116 includes a rotary section made up of spaced, upper and lower plates 136 and 138 extending outwardly from tubular portion 112, and a stationary section made up of tubular ring 140 positioned between plates 136, 138. Ring-shaped, rotary seals 142 are positioned against the upper and lower interior surfaces of ring 140 and held in place by upper and lower seal blocks 144 secured by bolts such as bolt 146. Connection pipe 148 extends outwardly from stationary ring 140 for connection to a conventional vacuum source. Plates 136, 138 and ring 140 define a vacuum chamber 148 to which vacuum lines 134 are connected in order to supply vacuum to bars 130.

As shown in FIG. 7, lower plate 138 extends beyond the periphery of ring 140. Sixteen brace rods 150 interconnect respective support members 24 with plate 138 by way of respective ball couplers 152 connected to lower plate 138.

Figure 6:
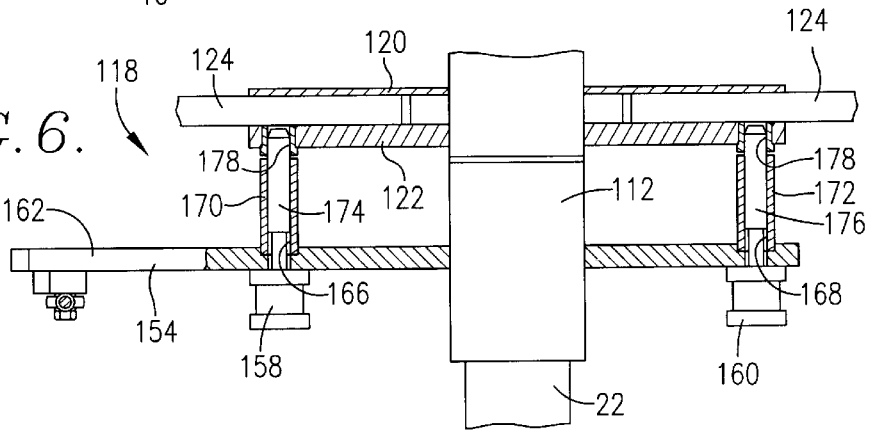
FIG. 6 is a partial sectional view of the indexing mechanism of FIG. 5.

Referring to FIGS. 2, 4 and 6, indexing mechanism 118 includes jack arm 154, indexing cylinder 156 and pin cylinders 158 and 160. Jack arm 154 is positioned below bottom plate 122, spanning the diameter thereof, and is connected and fixed to tubular portion 112 received therethrough. Jack arm 154 includes lever portion 162 extending outwardly beyond bottom plate 122.

One end of indexing cylinder 156 is connected pivotally to bracket 164 extending upwardly from one of support legs 24. The shaft of cylinder 156 is connected to lever arm 162 as shown in FIG. 5.

Pin cylinders 158, 160 are mounted to the lower face of jack arm 154 on opposed sides of tubular portion 112. The shafts of cylinders 158, 160 extend through respective apertures 166 and 168 defined through jack arm 154. Tubular pin guides 170 and 172 are mounted to the upper face of jack arm 154 in registration with holes 160, 168 and extend between jack arm 154 and bottom plate 122. Indexing pins 174 and 176 are received respectively in pin guides 170, 172.

Bottom plate 122 includes sixteen, bushing-lined, indexing holes 178 defined therethrough and evenly spaced adjacent the periphery of plate 122. Apertures 166, 168 and indexing holes 178 are positioned so that apertures 166, 168 are in registration with a pair of indexing holes 178 on opposite sides of tubular portion 112.

When air is applied to pin cylinders 158, 160, the shafts thereof extend and engage respective indexing pins 174, 176 in order to insert these pins into a respective pair of indexing holes 178. The application of air to indexing cylinder 156 extends the shaft thereof to push lever arm 162 thereby rotating jack arm 154. This rotates bottom plate 122 thereby rotating substrate handling assembly 20 in the clockwise direction from the viewpoint of FIGS. 1, 4 and 5.

Indexing cylinder 156 and lever arm 162 are dimensioned so that each activation of cylinder 156 rotates assembly 20 one index (1/16th of the circumference of press 110). At the end of one indexing movement, the air is released from pin cylinders 158, 160 to disengage jack arm 154 from bottom plate 122. Indexing cylinder 156 is then retracted to the position shown in FIG. 5. In this position, apertures 166, 168 are again in registration with a pair of indexing holes 178. Pin cylinders 158 are then activated to extend indexing pins 174, 176 in readiness for another indexing movement by indexing mechanism 118. The indexing movement carries any substrates held by vacuum bars 130 between the platens and the print heads.

As will now be appreciated, the structure of substrate handling assembly 20 is very light in weight. One reason for this is that assembly 20 does not carry or support platens 26–32. In prior art devices, rotatable components carried the platens thereby requiring much heavier support structures and more powerful drive systems to overcome the inertia. The present invention eliminates such problems because assembly 20 can be rapidly indexed because of its light weight.

In operation, printing press 10 performs an index cycle by first raising platens assembly 14 and substrate handling assembly 20 to the raised positions. This raises platens 26–32 into contact with the substrates and into contact with the print heads in order to perform printing, curing, preheating, and loading and unloading operations. After these operations, assemblies 14, 20 are lowered. Substrate handling assembly 20 is then rotated one index and the cycle repeats.

In use, an operator stands in front of loading and unloading platen 30. When substrate handling assembly 20 and platen assembly 14 are in the raised position, the top face of loading and unloading platen 30 is received through a respective pair of cross arms 26, 28 with a support member 124 on the operator's right and a vacuum bar 130 on the left as shown in FIG. 1.

In the raised position, the top face of platen 30 is flush, that is, even with the top surface of adjacent vacuum bar 130 having vacuum holes 132 therein. In this position, the substrate handling vacuum to holes 132 is released at the loading station, allowing the operator to remove a printed substrate. The operator then places a new substrate to be printed on platen 30 with the left edge of the substrate over vacuum holes 132 where the vacuum is re-initiated. In the preferred embodiment, the substrate is transfer paper but could include other substrates that can be screen printed such as textiles.

When the various printing and curing operations are completed, the air pressure is relieved from cylinders 62*b,d*. This action lowers platen assembly 14 and substrate handling assembly 20 to the lowered or spaced position, and reapplies vacuum to the loading station vacuum bar 130. In this position, platens 26–32 are below the level of vacuum bars 130 and the associated support structure, and vacuum bars 130 hold the respective substrates because of the vacuum applied thereto and to vacuum holes 132.

Air is then applied to indexing cylinder 156. The shaft of cylinder 156 extends to rotate jack arm 154 thereby rotating substrate handling assembly 20 to the next index position, such as preheat platen 32.

Cylinders 62*b,d* are then activated to raise platen assembly 14. Cylinders 62*a–d* have a stroke of 3.0 inches. That is, cylinders 62*a–d* raise tubular body 66 and thereby platen assembly 114 by a distance of 3.0 inches. After raising 2.5 inches, however, the upper end of tubular body 66 engages the lower end of tubular portion 112 of substrate handling assembly 20. This is the intermediate position illustrated in FIG. 14. In this position, guide wheels 180 (FIGS. 4 and 5) extending from opposite sides of selected support arms 40 on platen assembly 14 engage corresponding support members 124 on substrate handling assembly 20 to ensure these assemblies maintain registration.

In the intermediate position, the upper faces of platens 26–32 are flush with the top surfaces of vacuum bars 130 and the platens are in contact with any substrate held thereby. The vacuum holes in print platens 26 and curing platens 28 pull the substrates flat against the upper surfaces of the respective platens. The vacuum on platen holes 48, 56 is adjusted to be substantially less than that on vacuum bars 130, and is applied only when the platens are in the raised or print position. This ensures that the substrates are held securely in registration by bars 130 as the substrates move from station to station.

The continued upward motion to the end of the stroke by tubular body 34 (another 0.5 inches) raises tubular portion 112 and thereby substrate handling assembly by 0.5 inch to the raised or print position shown in FIG. 15. That is, platen assembly 14 and substrate handling assembly 20 move together for the last portion of the upward movement.

The raised position is also the print position for the printing stations. In the print position, print platens 26 place any substrate held thereon into contact with the lower surface of a corresponding print screen 94 as shown in FIG. 15. Squeegee cylinder 106 is then activated to rotate pivot arm 108 and pull tie rod 110. This action moves squeegee assembly 100 from the rearward edge of screen 94 to the forward edge thereof in order to apply ink through screen 94 to the substrate below. As described above, screen lift cylinders 96 maintain a constant force on the rearward edge of screen 94 in order to lift the screen from the substrate at substantially the same release angle despite variations in screen tension.

At the end of the printing operation, the air pressure is relieved from cylinders 62*b,d* and assemblies 14 and 20 shift to the lowered or spaced position shown in FIG. 13. Air pressure is again applied to indexing cylinder 156 in order to rotate substrate handling assembly one index.

A curing station is positioned adjacent, that is, downstream in the direction of movement of each printing station. The shifting of substrate handling assembly 20 to the raised position places each curing platen 28 into contact with any substrate that may be held by the corresponding vacuum bar 130. For each curing platen 28, the temperature is set as that temperature needed to cure the ink applied to the substrate by the previous print head.

As will be appreciated, a substrate presents a low thermal mass compared to a curing platen 28. As a result, a curing platen 28 rapidly heats the substrate to the platen temperature. Moreover, the substrate cannot exceed the platen temperature. This is in contrast to prior art infrared systems that sometimes overheat the ink beyond the desired curing temperature. Such is inherently prevented by the use of a heated curing platen in accordance with the present invention.

On the next indexing movement, the substrate is removed from the curing platen. Because of the low thermal mass of the substrate, it rapidly cools. Thus, the curing time is not exceeded. This has been a problem in the prior art in which the substrate remains in contact with a platen throughout the process. The prior art platen retains residual heat and continues to maintain the heat on the substrate, sometimes overheating the ink. Moreover, if the next position of the substrate is on a print platen, the substrate further cools to the temperature (typically ambient temperature) of this platen. Thus, the substrate is properly cooled with the previously applied ink thereon properly cured when the next printing operation begins.

A substrate continues to index from station to station around press 10 until it returns to loading and unloading platen 30. At this time the operator removes the printed substrate and can place a new substrate thereon as needed.

Preferred press 10 includes seven printing stations and adjacent curing stations. However, a greater or lesser number of such stations can be incorporated into press 10 as a matter of his own choice. Also, all seven stations need not be used when printing the substrate. For example, if a three color design is to be printed on a substrate, then only three of the print stations would be active.

Those skilled in the art will appreciate that the present invention encompasses many variations in the preferred embodiment described herein. For example, the various stations could be arranged linearly or in some other configuration different from that of the preferred circular arrangement of the present invention. Also, hydraulic cylinders could be used place of the preferred air cylinders, as could electric motor operator shifting mechanisms.

Having thus described the preferred embodiment the following is claimed as new and desired to be secured by Letters Patent:

1. A screen printing press comprising:

a plurality of operating stations including a respective plurality of platens each configured for receiving a substrate thereon and including a corresponding plurality of print heads, said platens and corresponding print heads being in registration and shiftable between respective spaced positions and print positions, each print head being operable for screen printing a substrate received on a corresponding platen when in said print position;

a shifting mechanism for selectively shifting said platens and corresponding print heads between said positions;

a substrate handling assembly operable for moving a substrate from one printing station to another;

said plurality of platens being positioned below said substrate handling assembly, said shifting mechanism being operable for shifting said plurality of platens upwardly along a center post until said plurality of platens engages said substrate handling assembly in order to shift said substrate handling assembly and said platens to said print positions.

2. The apparatus as set forth in claim 1 further including a plurality of curing stations respectively adjacent said printing stations.

3. The apparatus as set forth in claim 2, each curing station including a platen and means for heating said platen to a selected temperature.

4. The apparatus as set forth in claim 2, said substrate handling assembly being operable for moving a substrate from a printing station to an adjacent curing station.

5. The apparatus as set forth in claim 1, said operating stations being arranged in circular configuration.

6. The apparatus as set forth in claim 1, said operating stations being arranged in a circular configuration about a central axis being nonrotatable, said substrate handling assembly being operable for rotatable movement about said axis for moving substrates from one operating station to another between the respective platens and print heads of said printing stations.

7. The apparatus as set forth in claim 1, said substrate handling assembly including an indexing structure for moving substrates from one printing station to another in an indexing movement while pausing at each operating station.

8. The apparatus as set forth in claim 1, said substrate handling assembly including a plurality of vacuum arms each operable for holding a substrate along a leading edge thereof during indexing movement from one operating station to another.

9. The apparatus as set forth in claim 1, said printing press including a center post, and including a platen assembly supporting said platens, said platen assembly being coupled with said center post and slidable up and down said center post, said substrate handling assembly being slidable up and down said center post and rotatable thereabout.

10. The apparatus as set forth in claim 1 further including a loading and unloading station.

11. A screen printing press comprising:

a plurality of operating stations including a plurality of screen printing stations including a respective plurality of platens each configured for receiving a substrate thereon and including a corresponding plurality of print heads, said platens and corresponding print heads being in registration and shiftable between respective spaced positions and print positions, each print head being operable for screen printing a substrate received on a corresponding platen when in said print position;

a shifting mechanism for selectively shifting said platens and corresponding print heads between said positions; and a substrate handling assembly operable for moving a substrate from one printing station to another, and said operating stations being arranged in a circular configuration about a central axis and being non-rotatable, said substrate handling assembly being operable for rotatable movement about said axis for moving substrates from one operating station to another between the respective platens and print heads of said printing stations.

12. The apparatus as set forth in claim 11, said substrate handling assembly including an indexing structure for moving substrates from one printing station to another in an indexing movement while pausing at each operating station.

13. The apparatus as set forth in claim 12, said substrate handling assembly including a plurality of vacuum arms each operable for holding a substrate along an edge thereof during indexing movement from one operating station to another.

14. The apparatus as set forth in claim 13, said printing press including a center post aligned with said axis, and including a platen assembly supporting said platens, said platen assembly being coupled with said center post and slidable up and down said center post, said substrate handling assembly being slidable up and down said center post and rotatable thereabout.

15. The apparatus as set forth in claim 14, said platen assembly being positioned above said substrate handling assembly, said shifting mechanism being operable for shifting said substrate handling assembly upwardly along said center post until said substrate handling assembly engages said platen assembly in order to shift said platen assembly and said platens to said print positions.

16. A screen printing press comprising:

a plurality of operating stations including a plurality of screen printing stations including a respective plurality of platens each configured for receiving a substrate thereon and including a corresponding plurality of print heads, said platens and corresponding print heads being in registration and shiftable between respective spaced positions and print positions, each print head being operable for screen printing a substrate received on a corresponding platen when in said print position;

a shifting mechanism for selectively shifting said platens and corresponding print heads between said positions;

a substrate handling assembly operable for moving a substrate from one printing station to another, and said substrate handling assembly including a plurality of vacuum arms each operable for holding a substrate along an edge thereof during indexing movement from one operating station to another.

17. The apparatus as set forth in claim 16 wherein the edge comprises a leading edge.

18. The apparatus as set forth in claim 17 wherein the vacuum arms comprise a plurality of vacuum holes positioned in a substantially straight line.

19. The apparatus as set forth in claim 17 wherein the substrate handling system comprises a rotating vacuum hub holding the vacuum arms and defining platen openings to receive the platens therethrough.

20. A screen printing press comprising:

a plurality of operating stations including a plurality of screen printing stations including a respective plurality of platens each configured for receiving a substrate thereon and including a corresponding plurality of print heads, said platens and corresponding print heads being in registration and shiftable between respective spaced positions and print positions, each print head being operable for screen printing a substrate received on a corresponding platen when in said print position;

a shifting mechanism for selectively shifting said platens and corresponding print heads between said positions;

a substrate handling assembly operable for moving a substrate from one printing station to another, and said printing press including a center post and a platen assembly supporting said platens, said platen assembly being coupled with said center post and slidable up and down said center post by said shifting mechanism, said substrate handling assembly being slidable up and down said center post and rotatable thereabout.

21. The apparatus as set forth in claim 20, wherein the shifting mechanism includes a plurality of actuators operable to raise and lower the platen assembly.

22. The apparatus as set forth in claim 21, wherein at least one actuator includes a static pressure to balance the platen assembly and another actuator includes variable pressure to raise and lower the platen assembly.

23. The apparatus as set forth in claim 21, wherein the plurality of actuators includes two static pressure balancing actuators and two variable pressure lift actuators.

* * * * *